US007607391B2

(12) United States Patent
Haas et al.

(10) Patent No.: US 7,607,391 B2
(45) Date of Patent: Oct. 27, 2009

(54) SPRAY NOZZLE AND METHOD FOR DUSTING FRESHLY PRINTED PRODUCTS

(75) Inventors: Rainer Haas, Metzingen (DE); Nicolas Martin, Heidelberg (DE); Jürgen Ehrhard, Schönau (DE); Detlev Berlingen, Heidelberg (DE); Claudius Haas, Nuβloch (DE)

(73) Assignee: Weitmann & Konrad GmbH & Co. KG, Leinfelden-Echterdingen (DE)

( * ) Notice: Subject to any disclaimer, the term of this patent is extended or adjusted under 35 U.S.C. 154(b) by 345 days.

(21) Appl. No.: 11/234,103

(22) Filed: Sep. 26, 2005

(65) Prior Publication Data

US 2006/0107857 A1 May 25, 2006

(30) Foreign Application Priority Data

Nov. 19, 2004 (DE) ..... 10 2004 057 478

(51) Int. Cl.

| | |
|---|---|
| ***B41F 35/00*** | (2006.01) |
| ***B41L 41/00*** | (2006.01) |
| ***B05B 7/00*** | (2006.01) |
| ***B05C 19/00*** | (2006.01) |

(52) U.S. Cl. ..... 101/424.2; 118/308

(58) Field of Classification Search ..... 101/424.2; 427/180, 202, 424, 475; 118/308, DIG. 1, 118/314, 46, 629, 630, 236; 239/8, 705, 239/305

See application file for complete search history.

(56) References Cited

U.S. PATENT DOCUMENTS

| | | | | |
|---|---|---|---|---|
| 4,332,198 | A * | 6/1982 | Schmoeger | 101/424.2 |
| 4,598,870 | A * | 7/1986 | Schloz | 239/696 |
| 6,267,540 | B1 * | 7/2001 | Haas | 406/153 |
| 6,447,855 | B1 * | 9/2002 | Haas et al. | 427/598 |

FOREIGN PATENT DOCUMENTS

| | | |
|---|---|---|
| DE | 1 252 703 | 7/1963 |
| DE | 197 07 157 | 8/1998 |
| DE | 197 51 383 | 5/1999 |
| DE | 100 01 590 | 8/2001 |
| EP | 1116583 A2 * | 7/2001 |

* cited by examiner

*Primary Examiner*—Judy Nguyen
*Assistant Examiner*—Leo T Hinze
(74) *Attorney, Agent, or Firm*—Paul Vincent

(57) ABSTRACT

The invention concerns a spray nozzle for a powder duster for dusting freshly printed products with a connection for a tube for supplying a powder-air mixture, a distribution chamber and at least two nozzle channels which branch off from the distribution chamber like a fan, wherein the opening angle of the outer nozzle channels limiting the fan subtends an angular range of 5° to 20°, in particular an angular range of 8° to 15°, and preferably 12°. The invention also concerns a spray bar with spray nozzles of this type, a powder duster comprising spray nozzles of this type, and a method for dusting freshly printed products.

20 Claims, 2 Drawing Sheets

SPRAY NOZZLE AND METHOD FOR DUSTING FRESHLY PRINTED PRODUCTS

This application claims Paris Convention priority of DE 10 2004 057 478.2 filed Nov. 19, 2004 the complete disclosure of which is hereby incorporated by reference.

BACKGROUND OF THE INVENTION

The invention concerns a spray nozzle for a powder duster for dusting freshly printed products. The spray nozzle is provided with a connection for a tube for supplying a powder-air mixture, a distribution chamber and at least two spray channels which fan-off from the distribution chamber. The invention also concerns a method for dusting freshly printed products.

As is known in the art, freshly printed products, e.g. printed sheets with still wet printing ink, cannot be stacked since the ink would smear. For this reason, these printed sheets are dusted with powder, with the powder particles forming spacers between the printed sheets to prevent direct contact between the sheets and permit drying of the ink. During dusting of the printed sheets, one must ensure that, if possible, the entire powder is disposed on the surface of the printed sheet with as little powder as possible reaching the surroundings. For this reason, dusting apparatus are generally provided with suction systems which vacuum-off the powder which does not adhere to the sheet. The currently used spray nozzles have a spray angle of approximately 90°, and up to twelve spray nozzles of this type are mounted to a spray bar of approximately 1 m in length for dusting the printed sheet as evenly as possible using these spray nozzles. It has turned out that the printed sheet is dusted but a relatively large amount of powder reaches the surroundings. If the spray pressure of the powder-air mixture is increased, the powder rebounds from the surface of the printed sheet and even more powder is discharged into the surroundings. For this reason, the spray pressure of the powder-air mixture cannot be increased. Since the powder-air mixture is discharged with a relatively low pressure, the slightest air currents disturb the powder-air flow.

Ionisation systems are sometimes provided for electrostatically neutralizing the printed sheet to improve adhesion of the powder to the printed sheet. Moreover, in these dusting systems, an electrostatic field is present around the spray nozzles, thereby completely neutralizing the powder and the supporting air. This ensures that the printed sheet and the powder do not repel each other, since both are electrostatically neutral. As a result thereof, the powder distribution on the sheet is improved and less powder is consumed, since less powder migrates into the surroundings. However, the associated expense is relatively large due to installation of an ionisation system.

It is the underlying purpose of the invention to provide a spray nozzle which reduces the powder consumption in an inexpensive manner.

SUMMARY OF THE INVENTION

This object is achieved with a spray nozzle of the above-mentioned type, wherein the opening angle of the outer nozzle channels limiting the fan is in a range of between 5° and 20°, in particular in a range between 8° and 15° and preferably 12°. This object is also achieved with a method for dusting freshly printed products.

The spray nozzle in accordance with this invention has a substantially narrower spray jet for the powder-air mixture compared to conventional nozzles. The spray jet no longer has an opening angle of 90° as e.g. in prior art, but merely an opening angle of maximally 20°. 12° has proven to be particularly advantageous. It has turned out that, in case of very wide spray jets, i.e. spray jets having a very large opening angle, the powder particles in the outer region impinge on the surface of the printed sheet at a relatively flat angle and rebound, since the velocity component in the horizontal direction is relatively large. For a spray jet with powder particles impinging on the surface of the printed sheet at a very steep angle, the velocity component ($F_W$) extending in a horizontal direction is relatively small. For an opening angle of 12°, it is approximately 10% (tan 6°) of the force component ($F_S$) acting perpendicularly on the surface of the printed sheet. Since the powder particles have a very small force component extending in a horizontal direction, they can be blown out with a higher pressure without the danger that they rebound from the surface of the printed sheet.

The nozzles are oriented and/or dimensioned in such a manner that the jets are laterally supported and merge thereby slightly contacting but not overlapping when they meet the sheet. There are no gaps between the individual jets. This prevents the jets from being laterally blown away and also suppresses swirling of the powder. The jets can deflect only in the transport direction, i.e. towards the front or rear.

In a further development, at least one nozzle channel is orthogonal to the printed product to be dusted. The powder flowing from this nozzle channel thereby directly strikes the printed sheet from a vertical direction and completely remains thereon.

The nozzles are preferably disposed symmetrically with respect to the vertical. This ensures generation of a uniform spray image and uniform powder dusting of the printed sheets over their entire width.

The nozzle channels preferably have a circular or different cross-section, in particular, a rectangular or oval cross-section, wherein the larger dimension extends transversely to the transport direction of the printed product. This has the advantageous effect that a powder curtain can be generated using several adjacent spray nozzles, which extends over the entire width of the printed sheet and is still relatively thin. The opening angle of the fan in the transport direction of the printed sheet is nearly 0°, wherein, as mentioned above, the opening angle transverse to the transport direction may be up to 20° and in particular 12°. The linear powder application produces a powder "curtain" of small width. The jets exiting the nozzles meet the sheet at a very steep angle. The strong deflection of the jets on the sheet surface separates the transport air and the powder particles.

The length of the nozzle channel is preferably four to eight times, in particular, five to six times the diameter or its largest cross-sectional dimension. The relatively long nozzle channel causes settling of the powder-air mixture swirled in the distribution chamber and the powder particles are accelerated in the direction of the nozzle channel, and assume the direction of the nozzle channel. The powder is transported from the nozzle to the sheet via a round jet, preferably with supporting air.

Optimum and uniform distribution of the powder-air mixture to all nozzle channels is obtained in that the distribution chamber or its cross-section has the form of a bell. The powder-air mixture is supplied from the connection in the upper region of the distribution chamber which widens in the direction of the open side. The nozzle channels branch off from the open side of the bell. The transition between the connection and distribution chamber has sharp edges which produce acceptable turbulences.

The deflection from the horizontal connection into the almost perpendicularly oriented nozzle channels is improved in that the limiting wall of the distribution chamber opposite to the connection is inclined in such a manner that the powder-air mixture is deflected towards the nozzle channels. Powder build-up in the distribution chamber is prevented by the bell shape and, in particular, by the inclination of the rear wall.

The distribution chamber and the nozzle channels are preferably provided in a nozzle plate. This nozzle plate can be easily produced as a milled part or is injection-molded from plastic material. To prevent electrostatic charges, the plastic material may be electrically conducting and be connected to ground.

A connecting piece forming the connection is preferably screwed to the nozzle plate. The connecting piece has a thread for a screw cap. By providing connecting pieces of different designs, different tubes can be connected for the powder-air mixture, or the spray nozzle can be connected to different spray bars for different printing machines. For this reason, a plurality of combinations are possible.

The invention also concerns a spray bar having a width of approximately 1 m and at least 16, in particular 24, receptacles for spray nozzles in accordance with the above features. Since the spray cone or the fan-shaped spray jet is smaller, more spray nozzles are disposed next to each other on a spray bar compared to prior art to ensure even dusting of the printed sheet.

The invention also concerns a powder duster for use in a printing machine with a spray nozzle having the above-mentioned features. This powder duster is used to dust printed products, wherein the powder consumption is smaller compared to prior art, since less powder migrates into the surroundings.

One also attempts to provide the powder-air mixture with a larger momentum. This means that it is accelerated to a large speed or the mass is increased. A higher speed is obtained by reducing the flow cross-section of the spray nozzle. Cross-sections of a diameter of less than 4 mm generate a jet which is not sufficiently stable and is therefore easily deflected or disturbed by the surrounding air. If the diameter is too large, the amount of powder-air mixture required is unacceptably large which requires an excessively large compressor and disadvantageously increases the powder-air mixture consumption. The mass can be increased by increasing the pressure. The above-mentioned values produce a stable jet with high momentum.

Further features, advantages and details of the invention can be extracted from the claims and the following description which describes in detail a particularly preferred embodiment with reference to the drawing. The features shown in the drawing and mentioned in the description and in the claims may be essential to the invention either individually or in arbitrary combination.

DESCRIPTION OF THE PREFERRED EMBODIMENT

Figure 1:
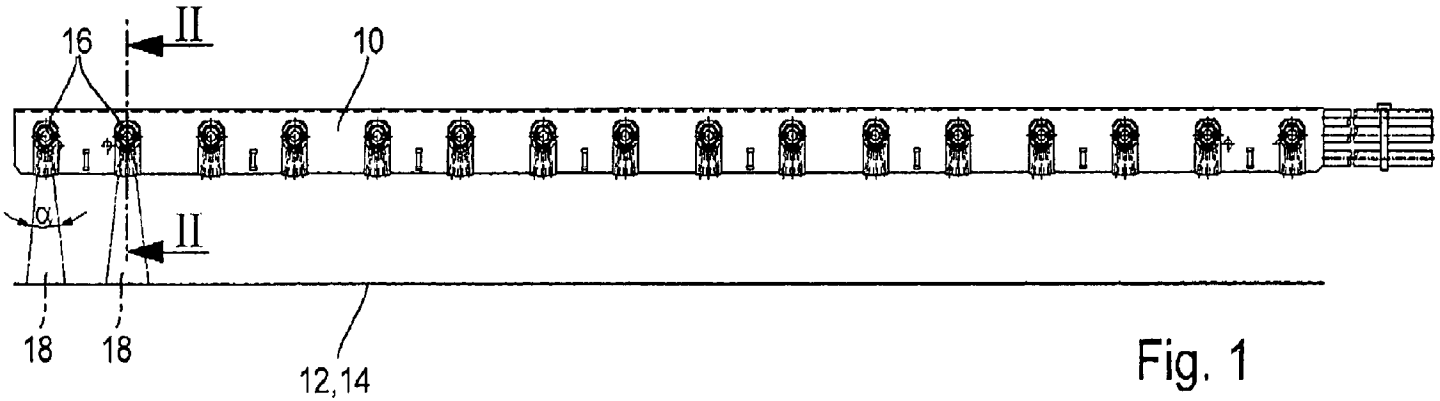
FIG. 1 shows a side view of a spray bar with spray nozzles mounted thereto.

FIG. 1 shows a spray bar 10 which extends transversely, i.e. across the width of a printed product 12, in particular, a printed sheet 14. The direction of extension or transport of the printed sheet 14 runs perpendicularly to the plane of the drawing. A total of sixteen spray nozzles 16 are mounted to the spray bar 10, which has a length of 1 m in the embodiment shown, for spraying a powder-air mixture onto the printed upper side of the sheet 14. The spray nozzles 16 are mounted to the spray bar 10 at equal separations from each other and can be advantageously individually controlled. The powder-air mixture is discharged by the spray nozzles 16 in the form of a spray cone 18, wherein neighboring spray cones 18 contact in the region of the printed sheet 14. The opening angle $\alpha$ of the spray cone 18 is 12°.

Figure 2:
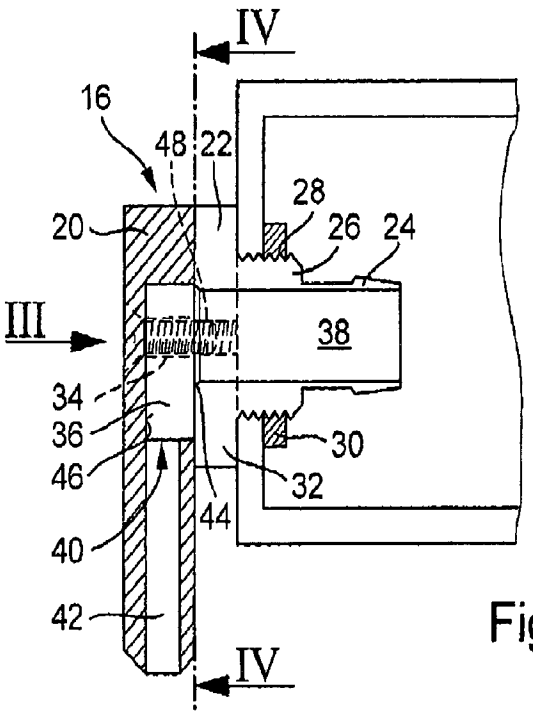
FIG. 2 shows a longitudinal section II-II through a spray nozzle in accordance with FIG. 1.

FIG. 2 shows a longitudinal section through a spray nozzle 16 which shows that it is constructed from a nozzle plate 20 and a connecting piece 22. The connecting piece 22 is a turned part which comprises a free end 24 onto which a tube can be pushed. Each spray nozzle is supplied with the powder-air mixture via a separate tube. This is advantageous in that the spray nozzles 16 can be individually controlled with the result that the device can be adjusted to different format widths.

Figure 4:
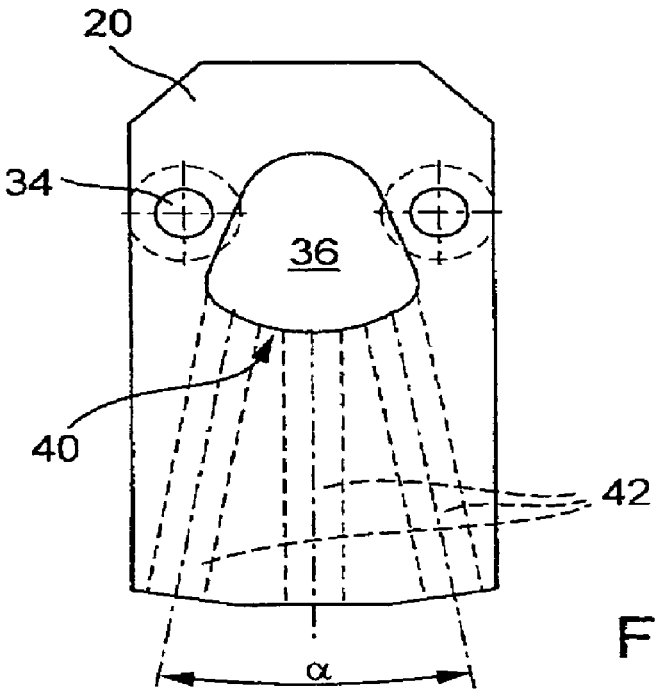
FIG. 4 shows a section IV-IV in accordance with FIG. 2, in a reduced scale.

An outer thread 28 is provided on a shoulder 26, onto which a screw cap 30 can be screwed. This screw cap 30 serves to mount the spray nozzle 16 to the spray bar 10. The connecting piece 22 is screwed to the nozzle plate 20 using a connecting piece plate 32, which has two openings 34 for receiving screws which are screwed into threaded bores provided in the connecting piece plate 32. The connecting piece 22 has a connection 38 which merges into a distribution chamber 36. This distribution chamber 36 is clearly shown in FIG. 4, in particular, its bell shape with three nozzle channels 42 opening into its open side 40. The nozzle channels 42 are disposed in the shape of a fan and the two outer nozzle channels 42 subtend an opening angle $\alpha$ of 12°.

FIG. 2 also clearly shows that the transition 44 between connection 38 and distribution chamber 36 has sharp edges. In the embodiment of FIG. 2, the rear wall 46 of the distribution chamber 36 is vertically oriented, but it may also be inclined such that the powder-air mixture supplied via the connection 38 is deflected in the direction of the nozzle channel 42.

Figure 3:
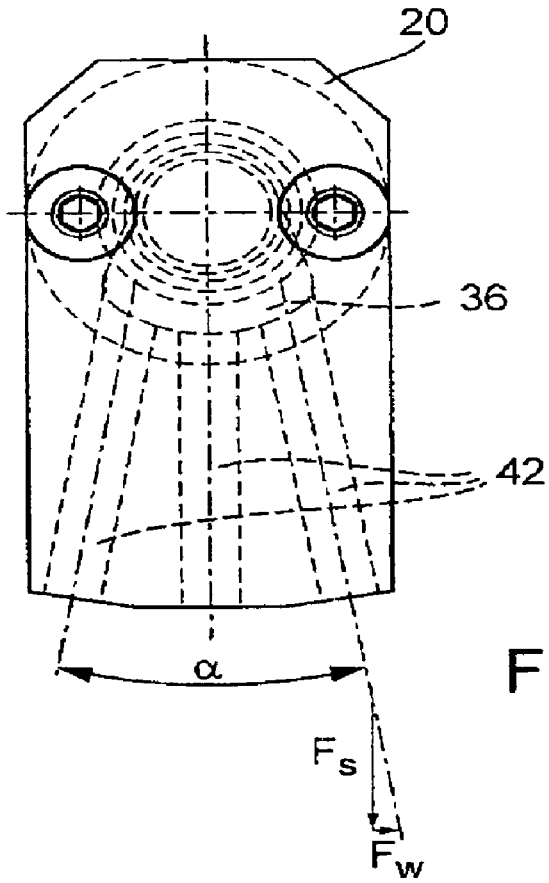
FIG. 3 shows a view in the direction of the arrow III in accordance with FIG. 2.

A spray nozzle 16 of this type can be used to spray the powder-air mixture onto the surface of the printed sheet 14 at a steeper angle, such that the force component $F_W$ acting in a horizontal direction is much smaller than the force component $F_S$ acting in a perpendicular direction (FIG. 3). $F_W=F_S*\tan \alpha/2$. The pressure for spraying the powder-air mixture onto the surface of the printed sheet 14 can thereby also be increased, since the danger of powder particles rebounding to the side is very small due to the small horizontal force ($F_W$). Dusting printed sheets 14 with spray nozzles 16 of this type reduces the powder loss.

We claim:

1. A powder duster spray nozzle system for dusting a freshly printed product via connection to a tube supplying a powder-air mixture, the printed product being transported beneath the spray nozzle system in a transport direction, the spray nozzle system comprising:

a spray nozzle, said spray nozzle having means defining a distribution chamber and at least two nozzle channels which fan-off from said distribution chamber, wherein, transverse to the transport direction of the product, an opening angle α between outer-most nozzle channels is between 8° and 15° and, in the transport direction of the product, each nozzle channel has an opening angle of 0° and a length which is four to eight times a diameter of its largest cross sectional dimension, thereby producing a line-shaped powder curtain of small width; means for connecting said spray nozzle to the tube; and means for holding said spray nozzle at a defined separation from the product, wherein said defined separation is selected and each nozzle channel is structured and dimensioned such that jets of powder and air emanating from adjacent channels slightly contact each other but do not overlap when they impinge on the product.

2. The spray nozzle system of claim 1, wherein at least one nozzle channel extends orthogonally to the printed product to be dusted.

3. The nozzle system of claim 1, wherein said nozzle channels are disposed symmetrically with respect to a vertical.

4. The spray nozzle system of claim 1, wherein said nozzle channels have a circular cross section.

5. The spray nozzle system of claim 1, wherein said nozzle channels have a non-circular cross section.

6. The spray nozzle system of claim 5, wherein said cross section is rectangular or oval, with a larger dimension extending transversely to a transport direction of the printed product.

7. The spray nozzle system of claim 1, wherein a length of said nozzle channel is five to six times a diameter of its largest cross sectional dimension.

8. The spray nozzle system of claim 1, wherein a cross section of said distribution chamber is bell-shaped.

9. The spray nozzle system of claim 8, wherein said nozzle channels branch-off from an open side of said bell-shape.

10. The spray nozzle system of claim 1, wherein a transition between said connecting means and said distribution chamber is bevelled.

11. The spray nozzle system of claim 1, wherein a limiting wall of said distribution chamber opposite said connecting means is inclined in such a manner that the powder-air mixture is deflected in a direction towards said nozzle channels.

12. The spray nozzle system of claim 1, wherein said distribution chamber and said nozzle channels are provided in a nozzle plate.

13. The spray nozzle system of claim 12, wherein a connecting piece forming said connecting means can be screwed to said nozzle plate.

14. The spray nozzle system of claim 13, wherein said connecting piece comprises a thread for a screw cap.

15. The spray nozzle system of claim 1, further comprising spray bar having a width of approximately 1 m and at least sixteen receptacles, each receptacle cooperating with one said spray nozzle.

16. The soray nozzle system of claim 1, further comprising a powder duster cooperating with said spray nozzle, said oowder duster structured and dimensioned for use in a printing machine.

17. A method for dusting a freshly printed product using a powder-air mixture blown out from at least one spray nozzle, the printed product being transported beneath the spray nozzle in a transport direction, wherein, transverse to the transport direction of the product, powder-air mixture jets exiting the spray nozzles are blown onto the printed product at a steep opening angle between outermost nozzle channels of 8° to 15°, each nozzle channel being structured and dimensioned and a separation between the nozzle and the product being adjusted such that jets of powder and air emanating from adjacent channels slightly contact each other but do not overlap when they impinge on the product, wherein, in the transport direction of the product, each nozzle channel has an opening angle of 0° with a length of the nozzle channel being four to eight times a diameter of its largest cross section, thereby producing a line-shaped powder curtain of small width.

18. The method of claim 17, wherein jets of the powder-air mixture are strongly deflected on a surface of the printed product.

19. The method of claim 17, wherein transport air and powder particles are separated on a surface of the printed product.

20. The method of claim 17, wherein the powder-air mixture has a high momentum.

* * * * *